United States Patent [19]

Baginski

[11] Patent Number: 4,967,665

[45] Date of Patent: Nov. 6, 1990

[54] RF AND DC DESENSITIZED ELECTROEXPLOSIVE DEVICE

[75] Inventor: Thomas A. Baginski, Auburn, Ala.

[73] Assignee: The United States of America as represented by the Secretary of the Navy, Washington, D.C.

[21] Appl. No.: 386,375

[22] Filed: Jul. 24, 1989

[51] Int. Cl.[5] ..... F42B 3/18

[52] U.S. Cl. ..... 102/202.2; 102/206

[58] Field of Search ..... 102/202.1, 202.2, 202.3, 102/202.4, 206

[56] References Cited

U.S. PATENT DOCUMENTS

| | | | |
|---|---|---|---|
| 2,918,001 | 9/1957 | Alford | 103/28 |
| 3,180,262 | 8/1962 | Talley et al. | 102/28 |
| 3,219,951 | 5/1963 | Clark | 333/79 |
| 3,343,491 | 9/1967 | Peters, Jr. | 102/202.2 |
| 3,435,259 | 3/1969 | Mette | 307/309 |
| 3,436,693 | 4/1969 | Gray | 333/79 |
| 3,640,224 | 2/1972 | Petrick et al. | 102/202.2 |
| 3,762,331 | 10/1973 | Vlahos | 102/70.2 |
| 3,882,323 | 5/1975 | Smolker | 102/202.5 |
| 4,061,088 | 12/1977 | Ueda | 102/202.4 |
| 4,273,501 | 6/1981 | Stratton | 102/202.2 |
| 4,539,617 | 9/1985 | Delaney et al. | 361/110 |
| 4,762,067 | 8/1988 | Barker et al. | 102/202.4 |
| 4,769,734 | 9/1988 | Heinemeyer et al. | 102/202.4 |
| 4,779,511 | 10/1988 | Proctor et al. | 86/50 |

FOREIGN PATENT DOCUMENTS

| | | | |
|---|---|---|---|
| 3204279 | 8/1983 | Fed. Rep. of Germany | 102/202.2 |
| 3502526 | 8/1985 | Fed. Rep. of Germany | . |
| 3545589 | 7/1987 | Fed. Rep. of Germany | 102/206 |

*Primary Examiner*—Harold J. Tudor
*Assistant Examiner*—Stephen Johnson
*Attorney, Agent, or Firm*—John D. Lewis; Kenneth E. Walden

[57] ABSTRACT

An insensitive electroexplosive device to electrically ignite explosives is disclosed. This device is inherently immune to radio frequency (RF) radiation, and also provides protection against DC or very low frequency RF induced by arcing. A central feature is use of zeners and capacitors to form a reactively balanced bridge circuit. When constructed in semiconductor form as described herein, the device is capable of incorporation in small caliber ordnance.

18 Claims, 2 Drawing Sheets

RF AND DC DESENSITIZED ELECTROEXPLOSIVE DEVICE

The U.S. Government has rights in this invention pursuant to Contract No. N60921-87-D-A315 between Southeastern Center for Electrical Engineering Education and the U.S. Department of Defense.

BACKGROUND OF THE INVENTION

The present invention relates to electroexplosive devices (EEDs) such as detonators, blasting caps and squibs. In particular, this invention relates to a method and device for desensitizing EEDs to electromagnetic radiation and electrostatic charges with the added ability to desensitize the device to essentially dc currents. This problem heretofore was considered intractable as the essentially dc currents induced by equipment arcing were similar to the system firing currents used to initiate the EED.

This is an improvement on Monolithic RF/EMI Desensitized Electroexplosive Device, the subject of a patent application, Ser. No. 280,049 filed on 12/05/88 by inventor, Thomas A. Baginski.

A variety of propulsion systems and ordnance depend upon an electrical signal to initiate combustion. This signal is typically a dc current. The current flows through a conductor (typically a bridgewire supported between two posts) which causes a rapid temperature rise via ohmic heating. Once the conductor reaches a sufficiently high temperature it ignites nearby material. The ignited material is then used to initiate combustion of secondary material. The device which consists of the conductor and primary combustionable material is referred to as an electroexplosive device (typically referred to as an EED or squib).

Over the past four decades the electromagnetic environment of an electroexplosive device has changed dramatically. The operation of high-power radar and communication equipment has introduced high-intensity electromagnetic fields to the environment. This problem is especially acute onboard Naval carriers with their multitude of high intensity electromagnetic sources.

The fields can be coupled into an electroexplosive device. The methods of coupling are direct radio frequency (RF) radiation (e.g., the EED acts as the load of a receiving antenna) and arcing associated with weapons procedures such as the attachment of an umbilical cable. These two events will be referred to as electromagnetic interference (EMI).

In an arc, the signal which is coupled into the EED has a wide range of frequency components including very low frequency and dc currents. Prior art thinking was generally that the dc and essentially dc signals, i.e., very low RF frequencies, were intractable problems as the firing circuits employed dc or a very low frequency, e.g., 400 hertz signals, to initiate the EED. Nearly all of the energy of the dc or essentially dc signal is almost instantaneously coupled into conventional bridgewire. Energy per unit time is power, which in our case can be extremely high because of the short time involved in an arcing event. Since power is high, a conventional bridgewire will heat and ignite or dud.

Various methods have been used to alleviate the problem of misfiring caused by electromagnetic radiation. Prior art systems have included inductive and capacitive components that form a balanced bridge or a tank to shunt unwanted signals from the bridgewire. One such protection device is disclosed in Parker et al., U.S. Pat. No. 3,181,464 issued May 4, 1965, which employs special conductors. Parker is used with EEDs having an exploding bridgewire. Other prior art devices add discrete components such as capacitors and inductors to form RF filters or otherwise electronically shunt unwanted signals away from the bridgewire. For example, Jones, U.S. Pat. No. 4,304,184 uses one or more inductors and ferrite beads to oppose and/or absorb unwanted current flow. Proctor et al., U.S. Pat. No. 4,378,738 passes the leads through ferrite chokes. Heretofore however, no device of monolithic construction, small enough to be used in small calibre ammunition, could deal with the dc and essentially dc components associated with an arcing event.

Also, prior art devices are often unsuitable for commercial production because of high manufacturing costs. The constant downsizing of ordnance requires a greater degree of miniaturization at the same time that greater efficiency and the ability to handle higher induced currents is required. As a result, a new design for a miniaturized highly effective EEd that is desensitized to both RFI and EMI is required; one that can endure essentially dc currents when an arcing event occurs.

SUMMARY OF THE INVENTION

Accordingly, it is an object of this invention to provide a RF protection device that is also an EED.

Another object of the instant invention is to provide a protection device for EEDs that effectively isolates the heating element from induced electromagnetic interference.

A further object of the present invention is to provide an RFI/EMI protection device that is miniaturized and can provide protection against arcing.

Yet another object of the present invention is to teach a device that may be incorporated into small calibre ammunition.

Still another object of the present invention is to disclose a method of constructing a miniaturized monolithic EED that provides protection against all frequencies of induced currents.

Another object of the present invention is to produce a protection device for ordance that is low in manufacture costs.

Yet another object of the present invention is to provide an EED protection device that is electrically and physically in close proximity to the heating element, thus reducing the coupling area for direct RF/EMI radiation.

Still another object of this invention is to teach an EED protection device that decreases the chances the EED will inadvertently fire or dud when exposed to radio frequency, microwave, arcing currents or electromagnetic radiation.

Another object of the present invention is to teach a monolithic RF/EMI protection device not subject to physical separation from the heating element.

A further object of the present invention is to teach a monolithic RF/EMI protection device which includes the heating element integral with the device.

A still further object of the present invention is to teach a device for broad band RF/EMI protection of ordnance which has an enhanced ability to withstand vibration and stress.

Yet another object of the present invention is to disclose a protection device for ordmance that protects against accidental firing from inadvertent arcing.

Another object of this invention is to provide a protection device that will not fail to ignite when receiving a firing signal after EMI exposure, arcing or severe mechanical stress.

Still another object of this disclosure is to teach a method of manufacture for a monolithic miniaturized EED.

A further object of this invention is to teach a method of manufacture of a monolithic miniaturized EED having the static electrical characteristics of a reactively balanced bridge circuit.

Still another object of the instant invention is to teach a device that can be utilized in a firing circuit containing discrete component capacitors and ferrites to increase high voltage handling capabilities.

Yet another object of the present invention is to teach an EED for protection against RF/EMI including dc or essentially dc components that can be constructed of discrete components or formed monolithically.

Accordingly, a protective device and method of constructing the device monolithically is hereinbelow disclosed which accomplishes all the above listed objects. The disclosed EED is basically two zener diodes and two capacitors connected to electrically form a reactively balanced switching bridge around a heating element. The zener diodes appear as an open switch to dc and essentially dc components below the zener breakdown voltage, thus protecting the EED from activating when exposed to an arcing event containing very low frequencies or dc components. At RF frequencies the bridge precisely balances the RF signal manifesting the same voltage at both ends of the heating element and thus precluding thermal initiation. The specific nature of the invention as well as the other objects, uses and advantages thereof will clearly appear from the following description and from the accompanying drawings, in which:

DETAILED DESCRIPTION OF THE INVENTION

Figure 1:
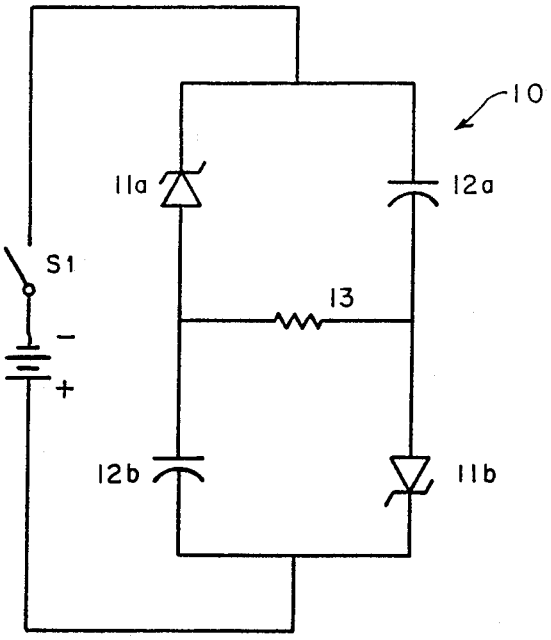
FIG. 1 is a schematic of the reactively balanced bridge of the present invention.

Turning now to FIG. 1, a schematic of this invention in its simplest form is illustrated. Therein, the numeral 10 designates generally the reactively balanced switching bridge forming the EED of the present invention. Zener diodes 11*a* and 11*b* are connected with two capacitors 12*a* and 12*b* in a manner resulting in the bridge circuit of FIG. 1. The bridge circuit surrounds a fuse or resistive igniter 13 that, when heated by electrical current, initiates the explosion.

Zener diodes possess a parasitic junction capacitance. The value varies greatly depending on whether discrete electrical components or semiconductors are used to form the bridge circuit. With semiconductors, the value is typically 50–500 pf, depending on the size of the diode, the type and density of the doping and other physical variables. If the value of capacitors 12*a* and 12*b* are chosen to equal the parasitic capacitance of zener diodes 11*a* and 11*b*, a balanced bridge results; see, FIG. 2.

The diodes appear as a capacitor to any induced RF signal, thus at RF frequencies the bridge precisely balances the RF signal between the inputs to bridge circuit 10. With the inputs balanced, the same RF voltage is present at both ends of heating element 13. With no difference in potential across fuse 13, no current flows through it and therefore element 13 does not heat.

If the EED suffers an arcing event resulting in a dc voltage coupled into the firing circuit, the zener diodes appear as an open switch to all potentials below that of the zener breakdown potential. The diodes act as switches once their breakdown voltage is exceeded. If a spurious dc signal less than the breakdown voltage of the diodes is imposed at the input of the EED, the diodes will not switch and the circuit remains open with no path for current flow through heating element 13. This configuration thus blocks low level dc signals such as those encountered during an arcing event and neutralizes induced RF signals resulting in no current flow through the fuse. Only when a dc or essentially dc signal exceeding the zener breakdown thresholds is induced in the circuit, will zeners 11*a* and 11*b* fire. When they fire they act as a closed switch completing a path for current to flow through closed diode 11*a* heating element 13 and closed diode 11*b*. This allows normal operation when S1, the firing switch, is closed to fire the EED. The firing signal is a dc or essentially dc signal with a potential above that of the breakdown potential of zeners 11*a* and 11*b*. 400 hz airborne power is often used as the firing current in airborne ordnance, and this is an example of an essentially dc signal.

Figure 2:
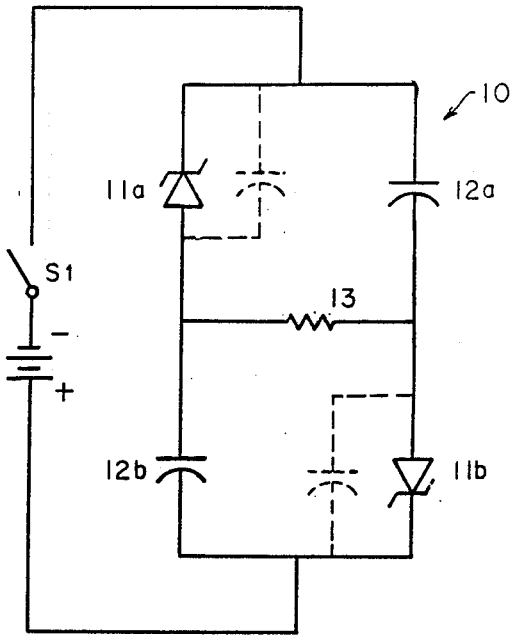
FIG. 2 is the circuit of FIG. 1 redrawn to show the parasitic capacitance separate from the zener dc current path.

FIG. 2 is the circuit of FIG. 1 redrawn so as to show the parasitic capacitance separate from the DC zener path.

It is important to note that while the reactively balanced switching bridge of the present invention may be constructed of discrete electrical components or fabricated as a semiconductor, the semiconductor model is considered as the best mode. The monolithic bridge circuit eliminates the problem of dudding of the device due to stress or vibration separating the components from the fuse or heating element. A monolithic construction also reduces the physical area available to couple RF or EMI signals to the heating element, and a monolithic device has a much lower coefficient of coupling than a device constructed by discrete components. With the monolithic construction technique, all interconnects are planar and offer exceptional reliability and long term stability.

Another advantage to a monolithic construction technique is a marked decrease in processing irregularities. The processing irregularities which can occur during wire drawing through a die include contamination, thickness variations and a variety of material defects such as dislocations. All these inhomogeneities can result in a small volume of the wire having significantly different characteristics than the bulk. When a EMI signal is passed through the wire the element may literally burn in two at the inhomogeneity though not ignite the EED. The result of this event is a squib which is now a dud and will not fire.

The advantage of using planar sputtering technology to fabricate the resistive element is that the technique produces films with exceptional purity, stoichiometry, and uniform thickness. The effect is to eliminate processing inhomogeneities that can later result in failures.

Another obvious but significant advantage to constructing the reactively balanced bridge circuit of the present invention in monolithic form is that the resulting device is miniaturized and can be used in small calibre ammunition. As the electromagnetic environment becomes increasingly more hostile it is necessary to immunize even small calibre electrically activated explosives such as 20 and 30 millimeter cannon rounds. With the monolothic embodiment the reactively balanced switching bridge can be incorporated into these small rounds.

Figure 3:
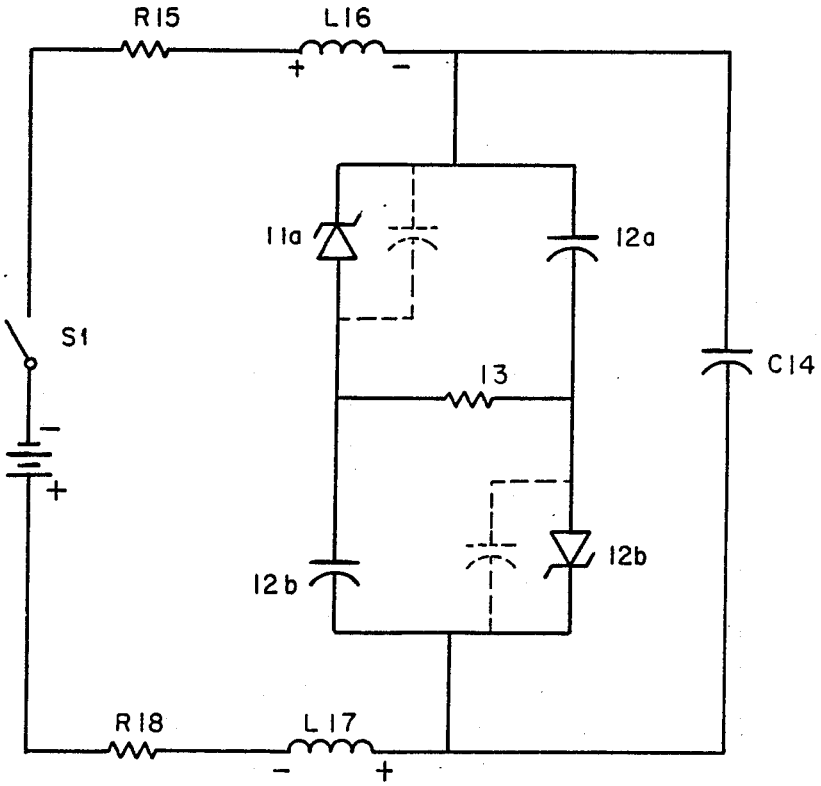
FIG. 3 is the circuit of FIG. 2 shown drawn with the schematic representation of discrete components included in the firing circuit to increase RF power handling capability.

If induced RF voltages exceeding the breakdown voltages of the zener diodes are expected, the reactively balanced switching bridge can be augmented by standard electrical components creating a shunt. The attenuation of the bridge can be greatly increased by adding ceramic capacitors and ferrites to the structure. Turning now to FIG. 3, the electrical schematic representation of the reactively balanced switching bridge is shown with a ferrite enhanced firing circuit. Therein R15 and R18 represent in line circuit resistance, L16 and L17 in line discrete component ferrite chokes of either inductive or resistive impedance and C14 is a ceramic capacitor. These additional components create a conventional RC divider network at RF frequencies.

To fire the EED, S1 is closed providing a dc voltage exceeding the threshold voltage of the zener diodes 11*a* and 11*b* to the circuit. The ferrites appear as short circuits. The zener 11*a* and 11*b* switch on and also appear as a short. The capacitors appear as open circuits resulting in the resistive heating element 13 forming essentially all the circuit load, thus heating and initiating the explosive device.

Figure 4:
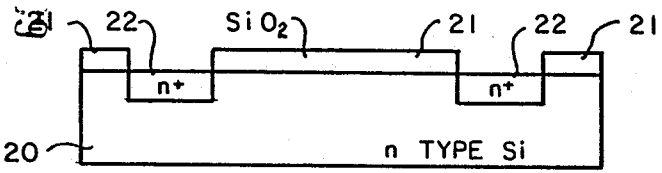
FIG. 4 is a graphic showing partial construction of a monolithic reactively balanced bridge of FIG. 1.
Figure 4A:
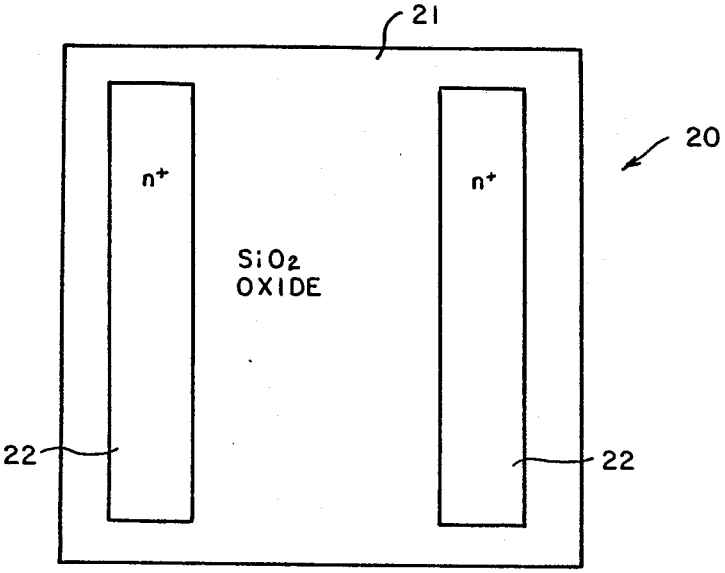
FIG. 4*a* is a top view of FIG. 4.

FIG. 4 and 4*a* are graphics showing the artwork on a semiconductor forming the reactively balanced bridge of the present invention designated generally with the numeral 20. Starting material for the structure was a <100> oriented, 3 in. diameter, 18 mill thick N type silicon substrate. The wafer 11 was then thermally oxidized to form an approximately 3000 angstroms thick layer of silicon dioxide $SiO_2$, designated 21. Either a wet-oxide or dry oxygen enhancement method may be employed to grow this silicon dioxide layer. This silicon dioxide layer forms a superb dielectric material and its permittivity remains constant well into the GHZ region.

Next, pattern the $SiO_2$ layer 21 by depositing a photo resist material thereon and spinning 1200–3000 rpm for about 15 seconds to remove excess; then bake the photo resist about 30 minutes at approximately 100° C. in a nitrogen environment; then pattern the photoresist to open diffusion windows 22; then etch oxide in buffered oxide etch; then apply phosphorous emulsitone film to top of wafer and spin at about 2000 rpm for 30 seconds; then bake wafer 20 for approximately 30 minutes to dry film; next insert wafer 20 into a furnace approximately 900° C. for 15 minutes. This diffusion forms a low resistance path connecting the bottoms of each pair of soon to be formed capacitors. This diffusion layer 22 is doped with any element forming N type material and is illustrated in FIG. 4*a*.

Next, remove emulsitone film and oxide by submersion in a buffered hydrofluoric acid bath and clean the wafer. Cleaning may be accomplished by rinsing in deionized water.

insert wafer 20 into a furnace at approximately 1100° C. for about 3 hours to further diffuse the phosphorus atoms.

Figure 5:
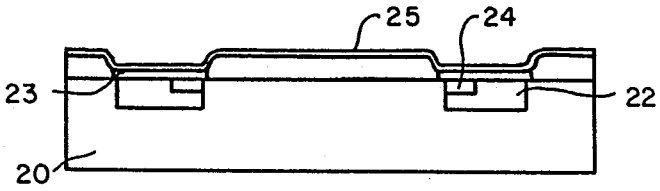
FIG. 5 is a graphic showing steps of construction subsequent to those illustrated in FIG. 4.
Figure 5A:
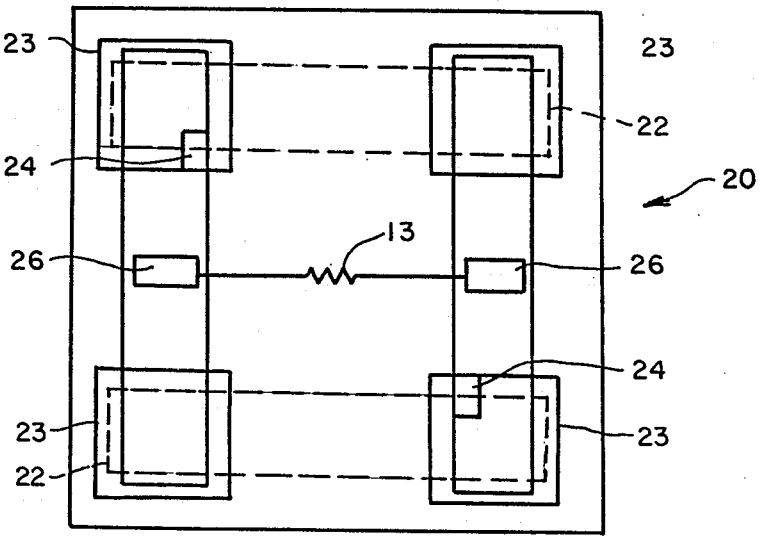
FIG. 5*a* is a top view of FIG. 5.

Next, oxidize the wafer as described above to form an oxide layer approximately 1000 angstroms thick; then again apply photoresist, spin and pattern the resist to open windows for boron diffusion which forms 4 capacitors 23 as illustrated in FIG. 5*a*, then insert wafer in furnace for approximately 15 minutes with boron or other P-type dopant to form a PN junction 24, as best seen in FIG. 5*a*.

At this point the P type boron has now formed a junction with the N type phosphorous diffusion which has been doped by a method known in the art to create zener diodes.

One skilled in the art will quickly realize that one could start with a P type wafer and form the monolithic device by creating a N-P junction without departing from the scope of the invention.

Finally, metal is deposited over the entire surface of wafer 20 forming a metalized layer to form an ohmic contact. This metal layer 25 may be evaporated or sputtered by techniques known in the art and nichrome, copper or gold may be used. Any metal that will form an ohmic contact will function and the tecnician should choose a metal according to application, i.e., gold if bonding aluminum.

A layer of aluminum or other metal may also be evaporated or otherwise deposited on the back of the backside of the silicon wafer to form the other ohmic contact to connect the device in the firing circuit.

Prototype devices were particularly effective by first coating the wafer with a bonding layer of nichrome approximately 50 angstroms thick and then depositing a relatively heavy layer of copper to form the ohmic contacts.

The wafer is again coated with photoresist spun to remove excess, pattened to form contact windows and etched to form these contact windows 26 as seen in FIG. 5*a*.

The final step in forming a monolithic EED is to form a resistive heating strip 13 to act as a fuse. This fuse is affixed in electrical contact between windows 26. This may be accomplished by depositing a nichrome film between the windows or simply soldering a resistive wire or attaching an ohmic bridgewire between them.

The result is a monolithic chip with the electrical characteristics displayed in FIG. 2.

It will be apparent that the embodiments illustrated are only exemplary and that various modifications can be made in construction, materials and methods within the scope of the invention as defined in the appended claims. In particular, any method of construction including soldering discrete electronic components, that electrically connects a zener diode and a capacitor pair, in parallel, to each end of a resistive heating strip to form a reactively balanced bridge circuit around a fuse is within the scope of this invention.

What is claimed is:

1. An RF and DC desensitized electroexplosive device comprising:

a plurality of zener diodes; and a plurality of capacitors; with a resistive heating element whereby said zener diodes and said capacitors form a reactively balanced bridge for cancelling the effects of RF energy induced into the device at the resistive heating element and for blocking DC induced currents below a threshold of said zener diodes from transmitting to the resistive heating element.

2. An RF and DC desensitized electroexplosive device according to claim 1 wherein said resistive heating element is a patterned layer of nichrome.

3. An RF and DC desensitized electroexplosive device according to claim 1 wherein said resistive heating element is a resistive heating wire.

4. An RF and DC desensitized electroexplosive device comprising:

a plurality of zener diodes constructed and doped to exhibit a parasitic junction capacitance of between 50 and 500 picofarads; and a plurality of capacitors constructed to exhibit capacitance approximately equal to the parasitic capacitance of said plurality of zener diodes, with a resistive heating element whereby said zener diodes and said capacitors form a reactively balanced bridge for cancelling the effects of RF energy induced into the device at the resistive heating element and for blocking DC induced currents below a threshold of said zener diodes from transmitting to the resistive heating element.

5. An RF and DC desensitized electroexplosive device comprising:

a plurality of zener diodes constructed by semiconductor techniques and doped to exhibit a parasitic junction capacitance of between 50 and 500 picofarads; and a plurality of capacitors constructed to exhibit capacitance approximately equal to the parasitic capacitance of said plurality of zener diodes; and a resistive heating element whereby said plurality of zener diodes and said plurality of capacitors form a reactively balanced bridge for cancelling the effects of RF energy induced into the device at the resistive element and for blocking DC induced currents below a threshold of said zener diodes from transmitting to said resistive element.

6. An RF and DC desensitized electroexplosive device according to claim 5 wherein said resistive heating element is an ohmic bridgewire.

7. An RF and DC desensitized electroexplosive device according to claim 5 wherein said resistive heating element is formed of a thin film strip of nichrome.

8. An RF and DC electroexplosive device according to claim 5 further defined by:

at least one capacitor in parallel with the reactively balanced bridge formed by said plurality of capacitors and said plurality of zenor diodes; and at least 1 inductor in series with the parallel circuit formed by said at least one capacitor.

9. An electroexplosive device according to claim 8 wherein said at least 1 capacitor is of ceramic form.

10. An electroexplosive device according to claim 5 further defined by a thin film ohmic coating formed over the device to provide an ohmic contact for connecting the device into an electrical circuit.

11. An electroexplosive device according to claim 10 wherein said ohmic coating is one metal chosen from a group consisting of nichrome, copper and gold.

12. A RF and DC desensitized electroexplosive device according to claim 5 further defined by:

a capacitor in parallel with said reactively balanced bridge; and at least one inductor in series with the parallel circuit formed by said reactively balanced bridge and said capacitor.

13. An electroexplosive device according to claim 12 fabricated in monolithic form by microelectronic techniques.

14. An electroexplosive device according to claim 12 wherein said capacitor is of ceramic form.

15. An electroexplosive device according to claim 12 further defined by:

a metal coating formed over the device and patterned to form ohmic contacts for connecting the device into an electrical circuit.

16. An electroexplosive device according to claim 15 wherein said metal coating is one metal chosen from a group consisting of nichrome, copper, or gold.

17. An electroexplosive device according to claim 12 wherein said balanced bridge is balanced around an ohmic bridgewire.

18. An electroexplosive device according to claim 16 wherein said reactively balanced bridge is formed of monolithic construction around a patterned nichrome heating element.

* * * * *